United States Patent [19]

Czerner

[11] Patent Number: 4,939,856

[45] Date of Patent: Jul. 10, 1990

[54] ADJUSTABLE STEAM FLOW CONTROL FOR AN ELECTRIC STEAM IRON

[75] Inventor: Peter A. Czerner, Trumbull, Conn.

[73] Assignee: Black & Decker Inc., Newark, Del.

[21] Appl. No.: 411,954

[22] Filed: Sep. 25, 1989

[51] Int. Cl.[5] ..... D06F 75/18

[52] U.S. Cl. ..... 38/77.7; 38/77.5; 38/77.8; 38/88

[58] Field of Search ..... 38/77.1, 77.5, 77.7, 38/77.9, 84, 85, 88

[56] References Cited

U.S. PATENT DOCUMENTS

| | | | |
|---|---|---|---|
| 2,387,757 | 10/1945 | Hoecker | 38/77.5 |
| 2,411,199 | 11/1946 | Felver | 38/77.7 |
| 2,418,511 | 4/1947 | Hume | 38/77.83 |
| 2,976,627 | 3/1961 | Kistner | 38/77.7 |
| 3,041,756 | 7/1962 | Foster | 38/77.5 |
| 3,224,122 | 12/1965 | Jepson | 38/77.5 X |
| 3,403,464 | 10/1968 | Martens | 38/77.7 |
| 3,605,299 | 9/1971 | Foster | 38/77.83 |
| 4,398,364 | 8/1983 | Augustine | 38/77.5 |
| 4,686,352 | 8/1987 | Nawrot | 38/88 X |
| 4,706,658 | 8/1988 | Emig | 38/77.7 |
| 4,748,755 | 7/1988 | Bain | 38/77.8 X |
| 4,748,755 | 6/1988 | Bain | 38/88 |
| 4,780,973 | 11/1988 | Vildosola | 38/77.7 |

FOREIGN PATENT DOCUMENTS

| | | |
|---|---|---|
| 3435654 | 4/1986 | Fed. Rep. of Germany . |
| 0041760 | 10/1984 | Japan . |

*Primary Examiner*—Werner H. Schroeder
*Assistant Examiner*—Ismael Izaguirre
*Attorney, Agent, or Firm*—Barry E. Deutsch

[57] ABSTRACT

An adjustable steam flow control for an electric steam iron includes a metering rod mounted in threaded engagement with a support bushing and having a lower end that extends into a valve orifice between the water reservoir and the steam generation chamber. A pinion gear is secured to the metering rod and engages a spur gear sector on a rotatably mounted steam adjust knob. Rotation of the steam adjust knob in one direction or the other by the user causes the metering rod to rotate in its bushing and advance into or retract from the orifice to thus control the steam flow rate. The steam control knob is provided with a spur gear sector so that partial rotation of the steam control knob will rotate the metering rod through its full range of motion. The present invention advantageously provides an adjustable steam flow control for an electric steam iron in which steam control can be precisely controlled and in which repeatable increments or decrements of steam flow can be obtained in a positive manner.

21 Claims, 2 Drawing Sheets

Fig.3
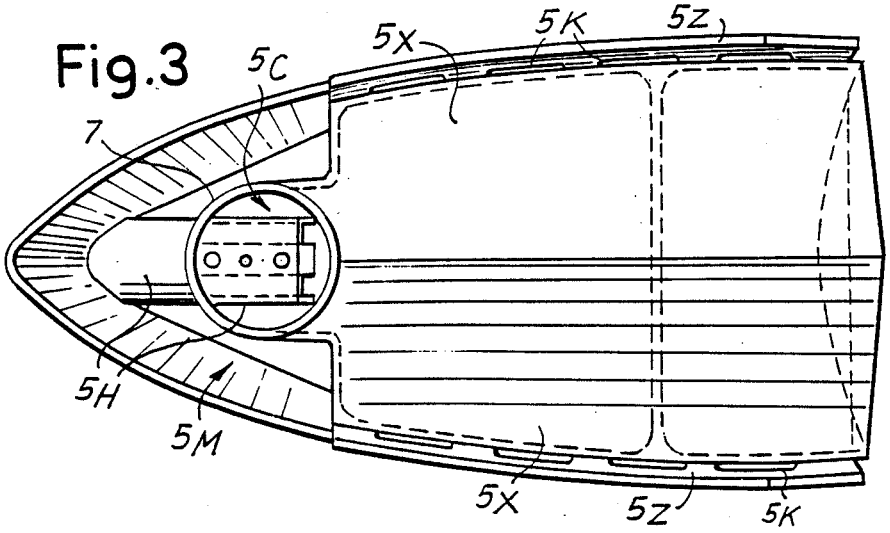
Fig.2
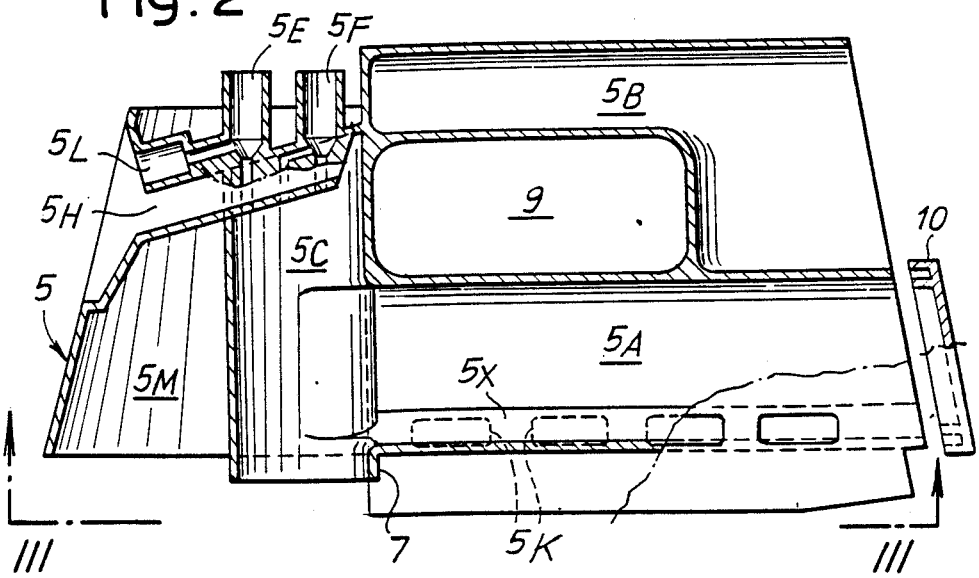
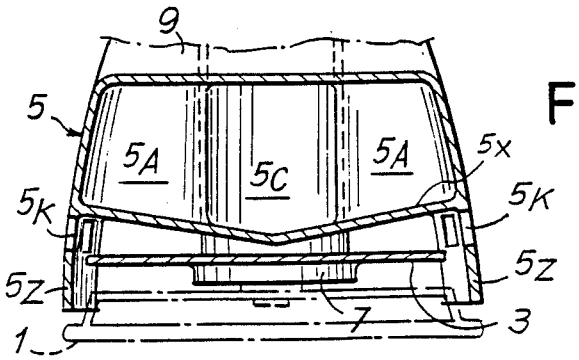
Fig.4

Fig. 7
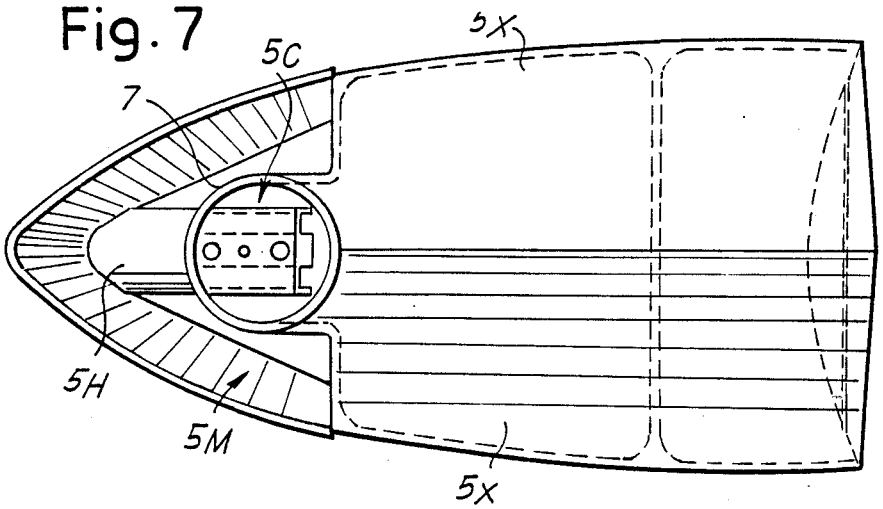
Fig. 6
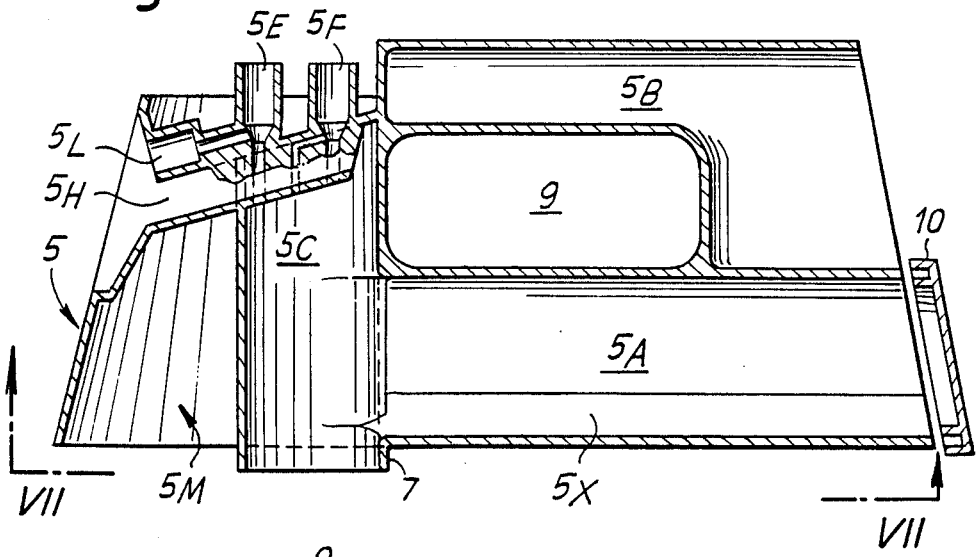
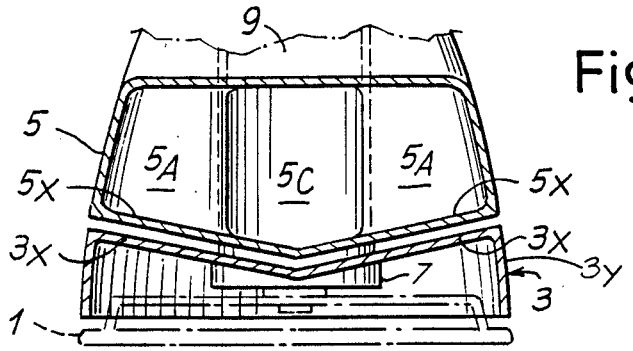
Fig. 8

ADJUSTABLE STEAM FLOW CONTROL FOR AN ELECTRIC STEAM IRON

BACKGROUND OF THE INVENTION

The present invention relates to an adjustable steam-flow control arrangement for an electric steam iron and, more particularly, to a steam flow control arrangement that provides precise and repeatable control of the steam flow in an electric steam iron.

Conventional electric steam irons include a steam generation circuit by which water in a reservoir is supplied to a steam generator with the steam directed to the fabric to be ironed. Most steam generation circuits include a metering valve by which the water flows from the reservoir in a drip-wise manner onto a heated surface, such as the soleplate, and is flashed to steam. The metering valve typically includes a small-diameter orifice between the water reservoir and the steam chamber with the distal end of a metering rod extending into the orifice. The distal end of the metering rod has a variable cross section so that the water flow rate can be controlled by extending the distal end into or withdrawing it from the orifice.

Various mechanical arrangements have been employed to control the position of the metering rod relative to the orifice with cam control being the most common. Typically, the electric iron is provided with a steam-flow control knob that is rotatable about an axis and which includes or is connected to a helical cam surface. The cam surface can include detent positions so that the user can select predefined "low," "medium," and "high" steam generation rates and can include an "off" position for dry ironing. The upper end of the metering rod is configured to engage the cam surface so that rotation of the steam control knob by the user in one direction will withdraw the other end of the metering rod from the orifice to increase the water flow to the steam chamber and rotation of the control knob in the other direction will extend the other end of the metering rod into the orifice to decrease the water flow to the steam chamber. The control arrangement is such that the metering rod can also seal the orifice to stop the water flow and the generation of steam to allow dry ironing. While cam control systems have enjoyed widespread use in the steam iron art, the cam-control system lacks a certain precision in its operation since dimensional clearances can accumulate so that it is often difficult to provide small increments or decrements in the steam flow.

Another type of steam control arrangement having a higher degree of control is the threaded-mount arrangement in which the metering rod is mounted in a threaded bushing in the body of the iron. A user-operable steam control knob is secured to the upper end of the metering rod and is rotatable by the user in one direction to withdraw the other end of the metering rod from the orifice to increase the water flow to the steam chamber and rotatable in the other end direction to insert the other end of the metering rod into the orifice to decrease the water flow to the steam chamber. Since the pitch of the screw threads can be specified at the design stage, precise and repeatable control can be obtained. However, the threaded mount arrangement, in contrast to the cam-control system, requires several rotations of the steam control knob to effect control throughout its full range of operation. Accordingly, it can be difficult to select a desired steam flow rate position.

SUMMARY OF THE INVENTION

In view of the above, it is an object of the present invention, among others, to provide an adjustable steam flow control for an electric steam iron that provides precise and repeatable control of the steam flow. It is another object of the present invention to provide an adjustable steam flow control for an electric steam iron in which precise and repeatable control of the steam flow can be obtained using a steam control knob in which the full steam flow range is obtained in less than one rotation of the steam control knob.

It is still another object of the present invention to provide an adjustable steam flow control for an electric steam iron in which small and precise increments or decrements of steam flow can be obtained.

In view of these objects, and others, the present invention provides an adjustable steam flow control for an electric steam iron which includes an orifice between the water reservoir and the steam generating chamber and a metering rod having a variable cross-section distal end for insertion into and withdrawal from the orifice to control the water flow rate to the steam generating chamber. The metering rod carries an externally threaded portion that is mounted in an internally threaded bushing carried in the support housing. A pinion gear is secured to the metering rod and engages spur gearing on a rotatably mounted steam adjust control. Rotation of the steam adjust control in one direction or the other by the user causes the metering rod to rotate in its bushing and advance into or retract from the orifice to thus control the steam flow rate. In the preferred embodiment, the steam adjust control is provided with a spur gear sector so that partial rotation of the steam adjust control will rotate the metering rod through its full range of motion.

The present invention advantageously provides an adjustable steam flow control for an electric steam iron in which steam control can be precisely and smoothly controlled in a positive manner without binding and in which repeatable increments or decrements of steam flow can be obtained.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
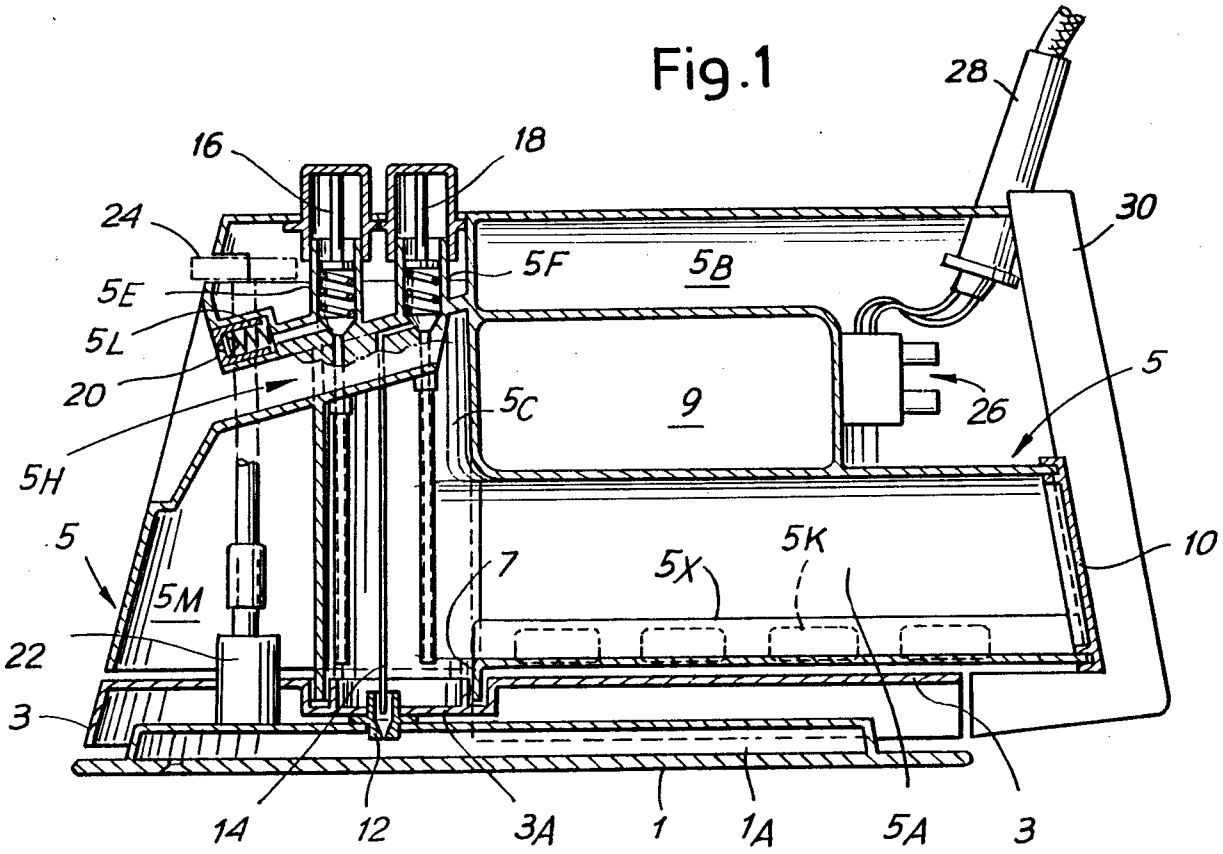
FIG. 1 is a side view, in cross-section, of an electric steam iron incorporating an adjustable steam flow control in accordance with the present invention.

An electric steam iron with an adjustable steam flow control in accordance with the present invention is shown in partial cross-section in FIG. 1 and is designated generally therein by the reference character 10. As shown, the steam iron 10 includes a body portion 12, a handle 14 for manipulating the steam iron 10, a forward or nose portion 16, and an electrically heated soleplate 18. A water-containing reservoir 20 is formed within the body portion 12 of the steam iron 10 and contains a supply of water used for the generation of steam, as explained below. The steam iron 10 includes a fill port (not shown) by which the reservoir 20 is periodically filled by the user, which reservoir 20 may include a transparent or translucent window by which the level of water in the reservoir 20 can be gauged by the user. The steam iron 10 is provided with a user-operable temperature control 22 to control the electric power provided to the soleplate 18 and a steam flow control knob 24 which controls the amount of steam issued from steam apertures (not shown) in the soleplate 18, as is conventional in the art. The temperature control 22 is coupled to a shaft 26, which, in turn, is connected to a thermostat (not shown) that periodically opens and closes an electric circuit to supply power to the soleplate 18 and thus establish the ironing temperature of the soleplate 18.

The soleplate 18 includes an interior surface portion 28 that is closed by a cover plate 30 to define a steam chamber 32 in which water from the reservoir 20 is flashed to steam, as explained more fully below. The steam chamber 32 is connected to passageways (not shown) that lead to the steam apertures formed in the soleplate 18 to provide the steam to the fabric being ironed. While a steam chamber 32 that is integral with the soleplate 18 has been shown in the preferred embodiment, the invention is applicable to those steam irons in which a separate flash-type boiler or flooded boiler is used to generate the steam.

Figure 2:
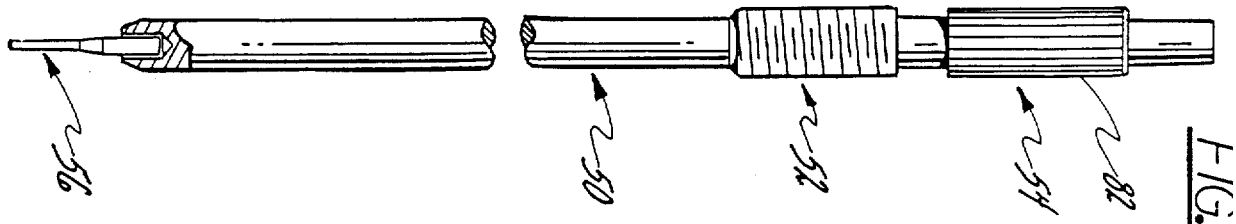
FIG. 2 is an elevational view of a metering rod.
Figure 3:
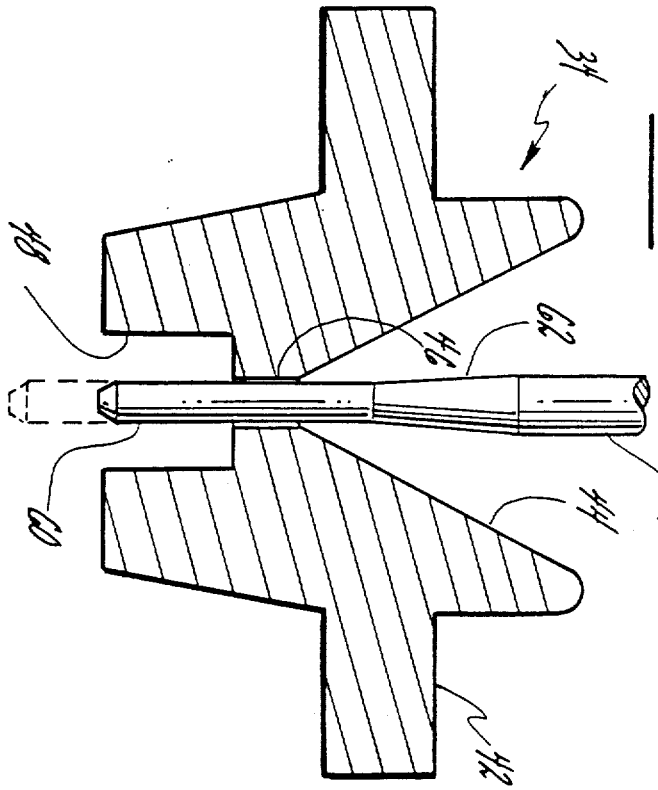
FIG. 3 is an enlarged detail of the distal end portion of the metering rod of FIG. 2 and its cooperating valve body.
Figure 5:
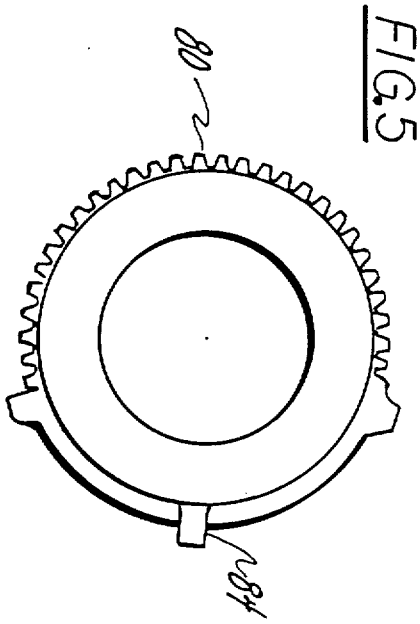

The flow of water from the reservoir 20 is controlled by a water metering system which includes a valve body 34 and a metering rod 36. The valve body 34, which may be fabricated from a moldable plastic, is fitted into a counterbore (unnumbered) in a bottom wall 38 of the reservoir 20 and held in position between the bottom wall 38 and the cover plate 30 by a compression gasket 40. The valve body 34 is formed as a body of revolution and includes an annular flange 42 that is received within the counterbore and bears against the gasket 40 to provide a fluid-tight seal. As shown in the enlarged detail of FIG. 3, the valve body 34 includes an entryway 44, a through orifice 46, and an exitway 48 for the flow of water from the reservoir 20 into the steam chamber 32. The metering rod 36, as shown in FIG. 2 and in the detail of FIG. 3, includes shank portion 50, an externally threaded segment 52, and a pinion gear 54 at its upper end. A metering pin 56 extends from the lower, or distal, end of the metering rod 36. As shown in the detail of FIG. 3, the metering pin 56 includes first diameter cylindrical portion 58, a second diameter cylindrical portion 60, and an intermediate frusto-conical section 62 that is tapered from the cylindrical portion 58 to the cylindrical portion 60. In the preferred embodiment, the first cylindrical portion 58 has a diameter of 0.76 mm, the second cylindrical portion 60 has a diameter of 0.508 mm, and the intermediate tapered frusto-conical portion 62 has a length of 2.0 mm. The metering rod 36 can be fabricated from a metal or a moldable plastic or can be formed as a two-piece assembly, as shown in the lower portion of FIG. 2, from a shank portion fabricated from a moldable plastic and a pin portion fabricated from a metal, such as brass. The second cylindrical portion 60 of the metering pin 56 is normally positioned, with an appropriate clearance dimension, within the orifice 46 of the valve body 34. The metering rod 36 is then adjusted to change the cross-sectional through-flow area of the orifice 46 by advancing the frusto-conical portion 62 into and out of the orifice 46 to control the flow of water from the reservoir 20 into the steam chamber 32 and, accordingly, control the steam flow.

Figure 6:
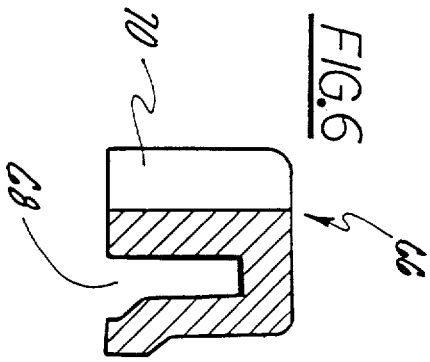
FIG. 6 is a side view, in partial cross-section, of an upper support bearing for the metering rod.

As shown in FIG. 1, the metering rod 36 is carried in an internally threaded bushing 64 that is mounted in or otherwise secured to an appropriate partition within the body portion 12 of the steam iron 10. As can be appreciated, rotation of the metering rod 36 in one direction or the other will cause the metering pin 56 at its lower end to advance into or retract from the orifice 46 to decrease or increase the water flow from the reservoir 20 into the steam chamber 32. In the preferred embodiment, the threads are 6-32 UNC threads to provide an axial displacement of 0.0313 inches for each full rotation of the metering rod 36. The upper end of the metering rod 36 is carried in a journal 66, which, as shown in the detail of FIG. 6, includes a mounting slot 68 for mounting on an appropriate partition in the handle 14 of the steam iron 10 and a semi-cylindrical bearing surface 70 for constraining the upper end of the metering rod 36. The provision of a semi-cylindrical bearing surface 70 in contrast to a full cylindrical bearing surface allows for a saving in material and simplicity of assembly while providing adequate bearing support for the upper end of the metering rod 36.

Figure 5:
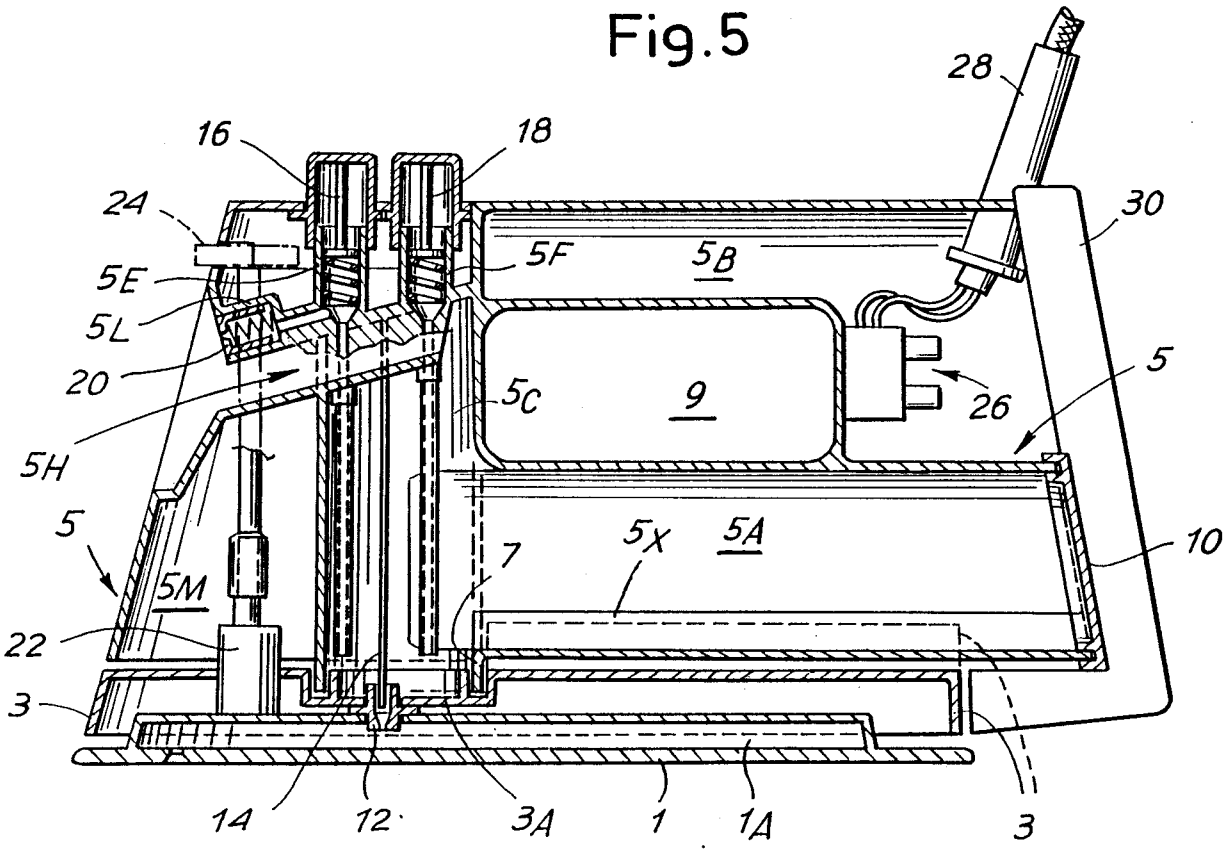
FIG. 5 is a top view, in cross-section, of the driver member of FIG. 4 in taken along line 5—5 of FIG. 4.
Figure 1:
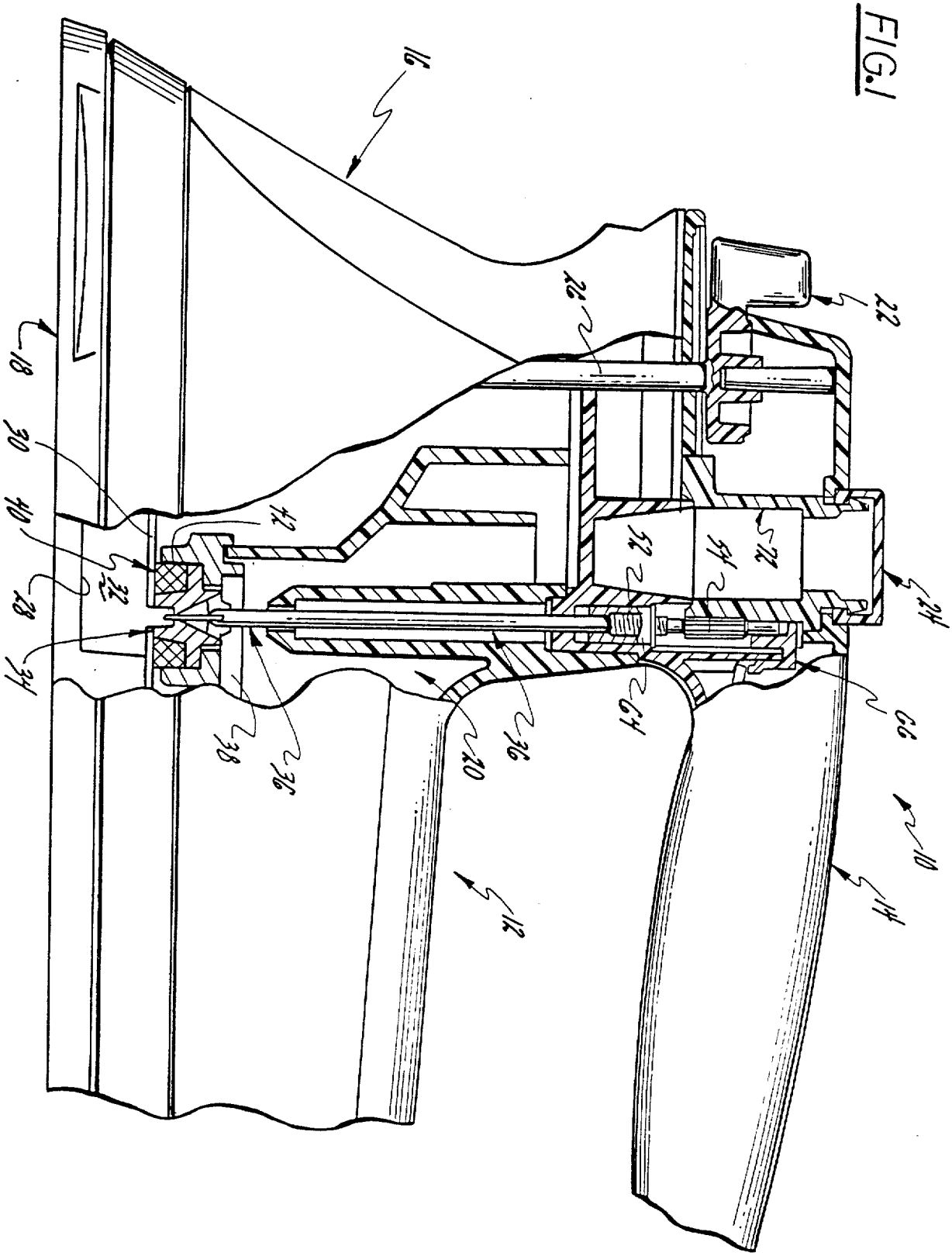
Figure 4:
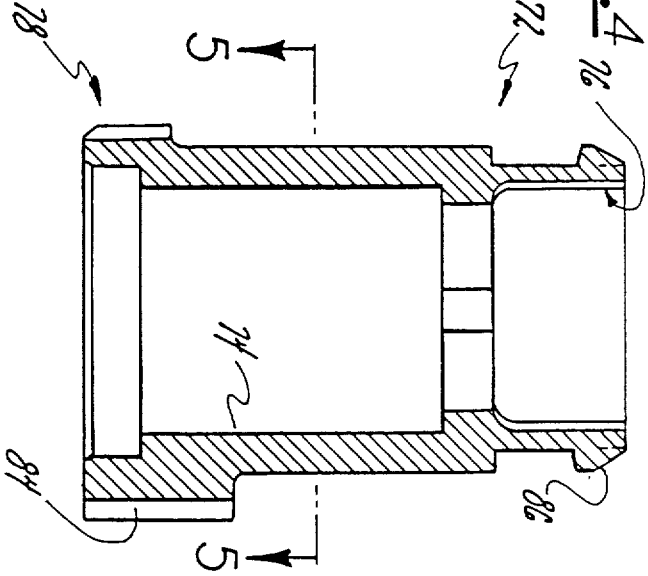
FIG. 4 is a cross-sectional elevation view of a steam adjust driver member of FIG. 1.

The rotary position of the metering rod 36 is controlled by the steam flow control knob 24 and a drive member 72. As shown in FIG. 1 and the cross-sectional view of FIG. 4, the drive member 72 includes an intermediate portion 74, an upper connection interface 76, and a lower portion that includes a gear sector 78. The drive member 72 is rotatably mounted in an appropriately sized opening in the handle 14 so that the gear sector 78 engages the pinion gear 54 of the metering rod 36. As shown in FIG. 5, the gear sector 78 includes gear teeth 80 that occupy an annular sector of approximately 200° and engage the gear teeth 82 of the pinion gear 54. In the preferred embodiment, the gear sector 78 includes 50 gear teeth 80 while the pinion gear 54 includes eight teeth 82 to provide a 6.25 step-up ratio between the gear sector 78 and the metering rod 36. The axially extending length of the gear teeth on one of the two gears, i.e., the pinion gear 54 in the preferred embodiment, is such that full tooth-to-tooth contact is maintained as the metering rod 36 is advanced or retracted throughout its range of motion. A radially extending tab 84 extends from the lower end of the drive member 72 and engages stop surfaces (not specifically shown) to limit the rotary motion of the drive member 72. The steam flow control knob 24 is connected to the upper end of the drive member 72 through the connection interface 76 which includes resilient latching tabs 86 that engage mating surfaces on the interior of the steam flow control knob 24 to connect the parts together.

In normal operation, the steam flow control knob 24 is rotated to a desired setting between a minimum and a maximum value. As a consequence of rotation of the steam flow control knob 24, the gear sector 78 is likewise rotated to rotate the engaged pinion gear 54 and its metering rod 36. As a consequence, the metering pin 56 (FIGS. 2 and 3) is raised from or inserted into the orifice 46 to increase or decrease the water flow rate from the reservoir 20 into the steam chamber 32. If desired, the metering rod 36 can be advance to completely block the orifice 46 to interrupt the flow of water to the steam chamber 32 to allow dry ironing.

The present invention advantageously provides an adjustable steam flow control for an electric steam iron in which steam control and adjustment is provided by a smooth, positive action when incrementing or decrementing steam flow in which the probability of binding or 'hang-up' is minimal.

As will be apparent to those skilled in the art, various changes and modifications may be made to the illustrated adjustable steam flow control for an electric steam iron of the present invention without departing from the spirit and scope of the invention as determined in the appended claims and their legal equivalent.

What is claimed is:

1. A steam control system for a steam iron, comprising:

a housing including a water reservoir and a steam-forming chamber;

a valving orifice between said reservoir and said steam-forming chamber for admitting water from said reservoir into said steam-forming chamber;

a longitudinally extending metering member having a portion extending into said valving orifice and movable toward and away therefrom to control the water flow between said reservoir and said steam-forming chamber, said metering member mounted in threaded engagement with said housing whereby rotation of said metering member about its longitudinal axis causes a change in the water flow rate between said reservoir and said steam-forming chamber;

a first gear member connected to said metering member for rotation therewith, a second gear member in engagement with said first gear member and rotatable in one direction or the other to rotate said metering member and effect a change in the water flow rate between said reservoir and said steam-forming chamber.

2. The steam control system of claim 1, wherein a N:M gear ratio exists between said first and said second gear members in which $N>M$.

3. The steam control system of claim 2, wherein a gear ratio of about 6:1 exists between said first and said second gear members.

4. The steam control system of claim 2, wherein said second gear member is constrained for rotation about an axis for a fraction of a full revolution.

5. The steam control system of claim 4, wherein said second gear member is constrained for rotation about an axis in a 200° range.

6. The steam control system of claim 2, wherein said second gear member is an external gear sector.

7. The steam control system of claim 1, wherein the portion of said metering member extending into said valving orifice has a cross-section that varies with length.

8. The steam control system of claim 1, wherein the portion of said metering member extending into said valving orifice is formed as a has a frusto-conical body.

9. A steam control system for a steam iron, comprising:

a housing including a water reservoir and a steam-forming chamber;

a valving orifice between said reservoir and said steam-forming chamber for admitting water from said reservoir into said steam-forming chamber;

a longitudinally extending metering rod having an end portion extending into said valving orifice, said metering rod mounted in threaded engagement with said housing whereby rotation of said metering rod about its longitudinally axis causes said metering rod to move axially toward and away from said valving orifice to control the water flow between said reservoir and said steam-forming chamber;

a pinion gear member connected to said metering member for rotation therewith;

a spur gear member in engagement with said pinion gear member and rotatable in one direction or the other to rotate said metering rod and effect a change in the water flow rate between said reservoir and said steam-forming chamber.

10. The steam control system of claim 9, further comprising a journal bearing supporting the end of said metering rod opposite said first-mentioned end portion for relative rotation.

11. The steam control system of claim 10, wherein said journal comprises a semi-cylindrical surface supporting said second-mentioned end of said metering rod.

12. The steam control system of claim 9, further comprising:

a rotatably mounted drive member, said spur gear connected to said drive member.

13. The steam control system of claim 12, further comprising a user-operable knob connected to said drive member.

14. The steam control system of claim 12, wherein said drive member is constrained for rotation about an axis for a fraction of a full revolution.

15. The steam control system of claim 14, wherein said drive member is constrained for rotation about an axis within a 200° range.

16. The steam control system of claim 14, wherein a N:M gear ratio exists between said spur gear and said pinion gear in which $N>M$.

17. The steam control system of claim 16, wherein a gear ratio of about 6:1 exists between said spur and said pinion gears.

18. A steam control system for a steam iron, comprising:

a housing including a water reservoir and a steam-forming chamber;

valve means between said reservoir and said steam-forming chamber for admitting a controlled flow of water from said reservoir into said steam-forming chamber;

a longitudinally extending metering member having a portion in engagement with said valve means and movable toward and away therefrom to cause said valve means to control the water flow between said reservoir and said steam-forming chamber, said metering member mounted in threaded engagement with said housing whereby rotation of said metering member about its longitudinal axis causes said valve means to change the water flow rate between said reservoir and said steam-forming chamber;

a first gear member connected to said metering member for rotation therewith, a second gear member in engagement with said first gear member and rotatable in one direction or the other to rotate said metering member and effect a change in the water flow rate between said reservoir and said steam-forming chamber.

19. The steam control system of claim 18, wherein a N:M gear ratio exists between said first and said second gear members in which N>M.

20. The steam control system of claim 19, wherein a gear ratio of about 6:1 exists between said first and said second gear members.

21. The steam control system of claim 20, wherein said second gear member is constrained for rotation about an axis for a fraction of a full revolution.

* * * * *

UNITED STATES PATENT AND TRADEMARK OFFICE

CERTIFICATE OF CORRECTION

PATENT NO. : 4,939,856

DATED : July 10, 1990

INVENTOR(S) : Peter A. Czerner

It is certified that error appears in the above-identified patent and that said Letters Patent is hereby corrected as shown below:

The title page should be deleted to appear as per the attached title page.

The 4 sheets of drawings, consisting of Figs. 1-8, should be deleted to be replaced with the 2 sheets of drawings, consisting of Figs. 1-6 as shown on the attached sheets.

Signed and Sealed this

Eleventh Day of December, 1990

*Attest:*

HARRY F. MANBECK, JR.

*Attesting Officer*

*Commissioner of Patents and Trademarks*

United States Patent [19]

Czerner

[11] Patent Number: 4,939,856

[45] Date of Patent: Jul. 10, 1990

[54] ADJUSTABLE STEAM FLOW CONTROL FOR AN ELECTRIC STEAM IRON

[75] Inventor: Peter A. Czerner, Trumbull, Conn.

[73] Assignee: Black & Decker Inc., Newark, Del.

[21] Appl. No.: 411,954

[22] Filed: Sep. 25, 1989

[51] Int. Cl.[5] ..... D06F 75/18

[52] U.S. Cl. ..... 38/77.7; 38/77.5; 38/77.8; 38/88

[58] Field of Search ..... 38/77.1, 77.5, 77.7, 38/77.9, 84, 85, 88

[56] References Cited

U.S. PATENT DOCUMENTS

| | | | |
|---|---|---|---|
| 2,387,757 | 10/1945 | Hoecker | 38/77.5 |
| 2,411,199 | 11/1946 | Felver | 38/77.7 |
| 2,418,511 | 4/1947 | Hume | 38/77.83 |
| 2,976,627 | 3/1961 | Kistner | 38/77.7 |
| 3,041,756 | 7/1962 | Foster | 38/77.5 |
| 3,224,122 | 12/1965 | Jepson | 38/77.5 X |
| 3,403,464 | 10/1968 | Martens | 38/77.7 |
| 3,605,299 | 9/1971 | Foster | 38/77.83 |
| 4,398,364 | 8/1983 | Augustine | 38/77.5 |
| 4,686,352 | 8/1987 | Nawrot | 38/88 X |
| 4,706,658 | 8/1988 | Emig | 38/77.7 |
| 4,748,755 | 7/1988 | Bain | 38/77.8 X |
| 4,748,755 | 6/1988 | Bain | 38/88 |
| 4,780,973 | 11/1988 | Vildosola | 38/77.7 |

FOREIGN PATENT DOCUMENTS

| | | |
|---|---|---|
| 3435654 | 4/1986 | Fed. Rep. of Germany . |
| 0041760 | 10/1984 | Japan . |

*Primary Examiner*—Werner H. Schroeder
*Assistant Examiner*—Ismael Izaguirre
*Attorney, Agent, or Firm*—Barry E. Deutsch

[57] ABSTRACT

An adjustable steam flow control for an electric steam iron includes a metering rod mounted in threaded engagement with a support bushing and having a lower end that extends into a valve orifice between the water reservoir and the steam generation chamber. A pinion gear is secured to the metering rod and engages a spur gear sector on a rotatably mounted steam adjust knob. Rotation of the steam adjust knob in one direction or the other by the user causes the metering rod to rotate in its bushing and advance into or retract from the orifice to thus control the steam flow rate. The steam control knob is provided with a spur gear sector so that partial rotation of the steam control knob will rotate the metering rod through its full range of motion. The present invention advantageously provides an adjustable steam flow control for an electric steam iron in which steam control can be precisely controlled and in which repeatable increments or decrements of steam flow can be obtained in a positive manner.

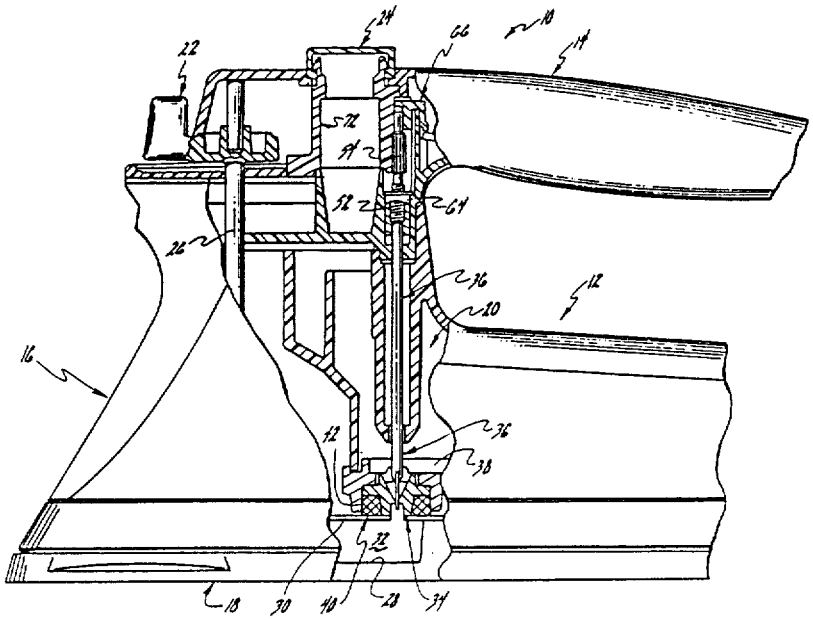

21 Claims, 2 Drawing Sheets